United States Patent [19]

Mastuno et al.

[11] Patent Number: 4,879,493

[45] Date of Patent: Nov. 7, 1989

[54] LOW-PRESSURE DISCHARGE LAMP

[75] Inventors: Hiromistu Mastuno, Hachioji; Seiichi Murayama; Tetsuo Ono, both of Kokubunji; Yoshio Watanabe, Tokyo, all of Japan

[73] Assignee: Hitachi, Ltd., Tokyo, Japan

[21] Appl. No.: 126,789

[22] Filed: Nov. 30, 1987

[30] Foreign Application Priority Data

Dec. 2, 1986 [JP] Japan ..... 61-285853

[51] Int. Cl.[4] ..... H01J 61/22

[52] U.S. Cl. ..... 313/641; 313/639; 313/637; 313/638; 315/99

[58] Field of Search ..... 313/629, 620, 619, 641, 313/639, 640, 637, 638; 315/DIG. 5, 99

[56] References Cited

U.S. PATENT DOCUMENTS 2,341,990 2/1944 Inman et al. .
2,403,184 7/1946 Lemmers .
2,832,912 4/1958 Lake ..... 313/109
4,463,285 7/1984 Nilssen ..... 315/DIG. 5
4,521,718 6/1985 Byszewski et al. ..... 315/99

FOREIGN PATENT DOCUMENTS 742803 9/1966 Canada ..... 313/619
5842158 8/1981 Japan .
8145055 8/1983 Japan .

OTHER PUBLICATIONS

Text Book Chapter 8, pp. 217–221, "Ionized Gases", by A. Von Engel, Published 1965.

*Primary Examiner*—Donald J. Yusko
*Assistant Examiner*—Brian S. Palladino
*Attorney, Agent, or Firm*—Antonelli, Terry & Wands

[57] ABSTRACT

Disclosed is a low-pressure discharge lamp comprising a discharge vessel defining an airtight space therein, at least one pair of electrodes disposed in the discharge vessel, and discharge gases enclosed in the discharge vessel, one of the electrodes which acts as an anode being located in a zone of negative glow.

18 Claims, 5 Drawing Sheets

LOW-PRESSURE DISCHARGE LAMP

BACKGROUND OF THE INVENTION

This invention relates to a low-pressure discharge lamp, and more particularly to a small-sized lowpressure discharge lamp which has a small distance between its cathode and its anode and which operates without any substantial anode fall voltage.

A single end type discharge lamp disclosed in Japanese patent application unexamined publications JP-A-58-42158 and JP-A-58-145055 is known as an example of a small-sized low-pressure discharge lamp having a small distance between its cathode and its anode.

The prior art low-pressure discharge lamp described above, was operated while continuously externally heating its cathode.

Due to the necessity for continuously externally heating the cathode in its steady state, the prior art low-pressure discharge lamp required two power supplies, that is, a cathode power supply and a discharge power supply. As another problem, the luminous efficacy of the prior art low-pressure discharge lamp was not high due to the necessity for continuously supplying cathode heating power from the cathode power supply.

SUMMARY OF THE INVENTION

It is an object of the present invention to provide a low-pressure discharge lamp which does not require continuous external heating of its cathode because of a unique electrode arrangement, which can be operated by power supplied from a single power supply only and which discharges with a high luminous efficacy In accordance with the present invention which attains the above object, there is provided a low-pressure discharge lamp comprising an airtight discharge vessel, at least one cathode and at least one anode disposed in the discharge vessel, and discharge gases enclosed in the discharge vessel, wherein the discharge gases include a rare gas as a main component, and the anode is disposed in a zone of negative glow. Because of the above features, no anode fall voltage appears in the low-pressure discharge lamp of the present invention, and the low-pressure discharge lamp can discharge at a low voltage and can operate with a high luminous efficacy.

The low-pressure discharge lamp of the present invention operates with both a high luminous efficacy and a large lumen maintenance factor when a mixture of a rare gas and mercury vapor is used as the discharge gases, and a layer of a rare earth activated phosphor or phosphors is coated on the inner wall of the discharge vessel made of, for example, glass. Further, when, in the low-pressure discharge lamp of the present invention, a layer or layers of, for example, $Al_2O_3$, $SiO_2$, $P_2O_7$, $Sb_2O_5$ or MgO are interposed between the phosphor layer and the glass wall forming the discharge vessel, high energy particles produced in plasma cannot reach the glass, thereby preventing blacking of the glass and improving the lumen maintenance factor.

Further, when a layer of at least one of materials such as Ba, BaO, $Ba_2CaW_6$ and $LaB_6$ is provided on the anode of the low-pressure discharge lamp of the present invention, the work function of the anode is reduced to increase the luminous efficacy.

The discharge vessel of the low-pressure discharge lamp of the present invention has preferably a generally spherical shape. When the discharge vessel is so shaped, the distribution of ultraviolet rays impinging against the inner wall of the discharge vessel is uniform, with the result that the luminous efficacy of the low-pressure discharge lamp is increased.

Further, the low-pressure discharge lamp of the present invention has preferably an electrode arrangement in which the cathode surrounds the anode or the anode surrounds the cathode. In the low-pressure discharge lamp having such an electrode arrangement, electron emitting materials vaporized from the cathode attach efficiently to the anode. Therefore, the work function of the anode is reduced to increase the luminous efficacy, and the amount of the electron emitting materials attaching to the inner wall of the discharge vessel decreases, so that the high luminous efficacy can be maintained over a long period of time.

A capacitor can be used as a ballast impedance in the low-pressure discharge lamp of the present invention. Even in such a case, no flicker of light occurs, and the normal service life of the low-pressure discharge lamp is maintained. Therefore, the ballast impedance can be made small in size and light in weight.

Further, provision of a single bi-polarity switching element only is sufficient to start discharge of the low-pressure discharge lamp.

Therefore, the starter can be made small in size.

DESCRIPTION OF THE PREFERRED EMBODIMENTS

Figure 1:
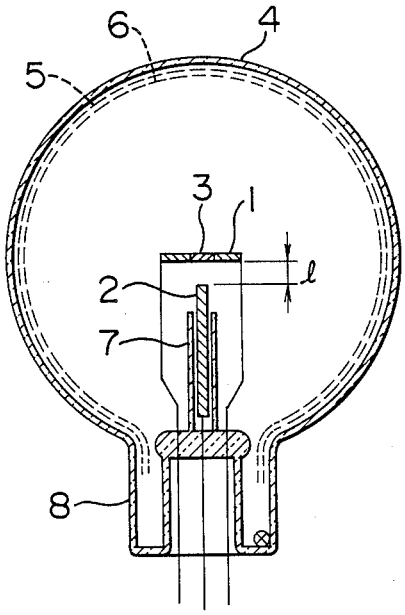
FIG. 1 is a schematic sectional view of a first embodiment of the low-pressure discharge lamp according to the present invention.

First, the basic principle of the present invention will be described. The inventors made various researches and studies on low-pressure discharge lamps containing a rare gas as an essential component of discharge gases and having a relatively short distance between their cathode and their anode. As a result of the researches and studies, the inventors discovered the following important characteristics of the low-pressure discharge. When the anode of a low-pressure discharge lamp was disposed in a zone of negative glow, the lamp voltage sharply decreased, and the low-pressure discharge lamp could discharge at a low voltage and could operate with a good luminous efficacy without the need for continuously externally heating the cathode.

Especially, such a low-pressure discharge lamp containing a rare gas as an essential component of discharge gases could discharge stably and could operate with an excellent luminous efficacy when the lamp voltage was set at a value intermediate between a value lower by 2V than the lowest metastable potential Vm (V) of the rare gas and a value higher by 4 V than Vm, that is, between (Vm−2) V and (Vm+4) V, by suitably adjusting the position of the anode in the zone of negative glow, the shape of the anode, the shape of the cathode, etc.

Generally, no positive column is present in such a low-pressure discharge lamp in which the distance between the cathode and the anode is short. The lamp voltage $V_L$ of such a low-pressure discharge lamp is expressed by the following equation (1):

$$V_L=(V_K-W_K)+(V_A+W_A) \quad (1)$$

where $V_K$ is the cathode fall voltage, $W_K$ is the work function of the cathode, $V_A$ is the anode fall voltage, and $W_A$ is the work function of the anode. Further, the radiant efficiency $\eta$ of light radiated under low-pressure discharge is expressed by the following equation (2):

$$\eta = \frac{\phi_K + \phi_A}{V_L I_L} = \frac{\phi_K + \phi_A}{\{(V_K - W_K) + (V_A + W_A)\} I_L} \quad (2)$$

where $I_L$ is the discharge current, $\phi_K$ is the amount of luminous flux emanating due to the cathode fall, and $\phi_A$ is the amount of luminous flux emanating due to the anode fall. The amount of the luminous flux $\phi_A$ emanating due to the anode fall is very small and is almost negligible when compared with that of the luminous flux $\phi_K$ emanating due to the cathode fall. Thus, the anode fall voltage $V_A$ acts as a source of increasing the lamp voltage and heating the anode, thereby giving rise to a loss which leads to an undesirable reduction of the radiant efficiency $\eta$.

The inventors made probe measurements to know the reason why the disposition of the anode in the zone of negative glow caused such a sharp decrease of the lamp voltage $V_L$ of the low-pressure discharge lamp and found that the sharp decrease of the lamp voltage was caused by a sharp decrease of the anode fall voltage $V_A$. That is, the lamp voltage $V_L$ decreased greatly when the anode was disposed in the zone negative glow, while, on the other hand, the amount of the luminous flux did not appreciably decrease. Therefore, the high luminous efficacy was obtained.

As described above, the low-pressure discharge lamp could discharge stably when the lamp voltage was set at a value between (Vm−2) V and (Vm+4) V, where Vm is the lowest metastable potential of a rare gas which is an essential component of discharge gases, and the high luminous efficacy was exhibited under the above condition. The inventors consider that this high luminous efficacy is attributable to efficient cumulative ionization of the rare gas in the zone of negative glow. Thus, the inventors found that, when the anode of a low-pressure discharge lamp containing a rare gas as an essential component of discharge gases was located in a zone of negative glow, the discharge lamp could discharge at a low lamp voltage with a high luminous efficacy without the need for continuously externally heating the cathode.

The result described above was obtained by application of the present invention to a low-pressure discharge lamp of DC discharge type having an anode and a cathode. However, it is obvious that the same result can also be obtained by direct application of the present invention to a low-pressure discharge lamp of AC discharge type.

Figure 3:
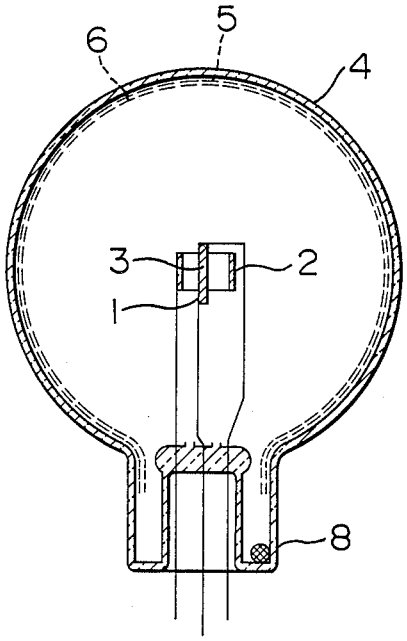
FIG. 3 is a schematic sectional view of a third embodiment of the low-pressure discharge lamp according to the present invention.

The low-pressure discharge lamp of the present invention utilizes plasma appearing in the vicinity of the cathode, whereas a conventional fluorescent lamp utilizes a positive column. Therefore, when the low-pressure discharge lamp of the present invention is continuously operated over a long period of time, electron emitting materials scattered from the cathode attach to the inner wall of the discharge vessel of glass, thereby tending to decrease the transmittance for light and lower the luminous efficacy of the discharge lamp. An embodiment of the low-pressure discharge lamp of the present invention which obviates the disadvantage pointed out above is shown in FIG. 3. The low-pressure discharge lamp shown in FIG. 3 comprises a hollow cylindrical anode 2 surrounding a cathode 2 in a discharge vessel 4 containing a rare gas as an essential component of discharge gases. The inventors discovered that, when such an electrode arrangement was employed, the light transmittance of the discharge vessel 4 was not lowered, and a high luminous efficacy could be maintained even when the discharge lamp was continuously operated over a long period of time. The inventors consider that the reason why the high luminous efficacy can be maintained by the employment of the electrode arrangement described above owes to a mechanism as described below. That is, electron emitting materials spattered from the cathode 1 migrate through the rare gas toward the discharge vessel 4 by diffusion, but most of them attach to the radially inner and outer surfaces of the hollow cylindrical anode 2 located between the discharge vessel 4 and the cathode 1 and cannot reach the inner wall of the discharge vessel 4. Therefore, the light transmittance of the discharge vessel 4 is not lowered. On the other hand, high energy plasma produced in the zone between the cathode 1 and the cylindrical anode 2 diffuses from both ends of the cylindrical anode 2 toward and into the entire internal space of the discharge vessel 4. Therefore, the luminous efficacy of the low-pressure discharge lamp is not appreciably reduced even by the employment of the electrode arrangement in which the cathode 1 is surrounded by the cylindrical anode 2.

Figure 5:
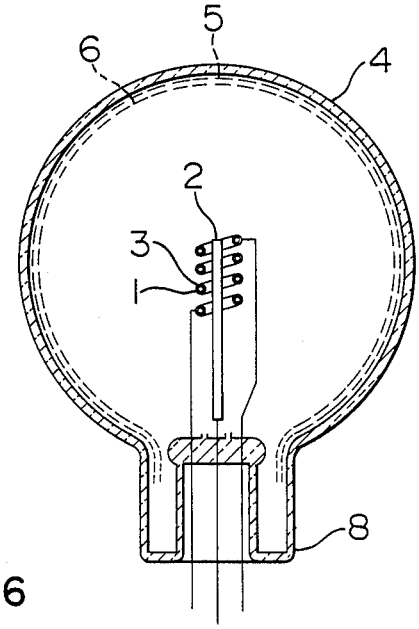
FIG. 5 is a schematic sectional view of a fifth embodiment of the low-pressure discharge lamp according to the present invention.

Another embodiment of the low-pressure discharge lamp of the present invention which obviates the aforementioned disadvantage is shown in FIG. 5. The low-pressure discharge lamp shown in FIG. 5 comprises a cathode 1 surrounding an anode 2 in a discharge vessel 4 containing a rare gas as an essential component of discharge gases. The inventors discovered that, when such an electrode arrangement was employed, the light transmittance of the discharge vessel 4 was not lowered, and a high luminous efficacy could be maintained even when the discharge lamp was continuously operated over a long period of time. The inventors consider that the reason why the high luminous efficacy can be maintained by the employment of the electrode arrangement described above owes to a mechanism as described below. That is, electron emitting materials scattered from the cathode 1 do not move straightforward unlike a light beam, but migrate through the rare gas toward the discharge vessel 4 by diffusion. Therefore, when a body attracting such electron emitting materials is present in the vicinity of the cathode 1, most of the spattered electron emitting materials diffuse toward the body present in the vicinity of the cathode 1, and the amount of the electron emitting materials migrating toward the discharge vessel 4 decreases. In the low-pressure discharge lamp of the present invention shown in FIG. 5, the anode 2 arranged to be surrounded by the cathode 1 provides the body attracting the electron emitting materials. Thus, most of the electron emitting materials spattered from the cathode 1 attach to the anode 2, and the amount of the electron emitting materials attaching to the inner wall of the discharge vessel 4 is small. Accordingly, the light transmittance of the discharge vessel 4 is not lowered to maintain the high luminous efficacy.

As will be apparent from the equation (2) described above, the luminous efficacy of the low-pressure discharge lamp increases with the decrease in the work function $W_A$ of the anode. In the low-pressure discharge lamp of the present invention shown in FIG. 5, suppose, for example, that the anode 2 is disposed in the zone of negative glow (that is, the distance between the cathode 1 and the anode 2 is smaller than 17 mm); krypton is an essential component of discharge gases; the cathode 1 is in the form of a tungsten coil coated with electron emitting materials whose essential component is BaO; and the anode 2 is made of nickel, the work function $W_A$ of the anode in this low-pressure discharge lamp is 4.8V whereas the lamp voltage $V_L$ is low or in the order of about 11V and the loss attributable to the work function $W_A$ of the anode amounts to about 44% of input power supplied to the low-pressure discharge lamp. Therefore, it is apparent that, in the lowpressure discharge lamp of the present invention, decreasing the work function $W_A$ of the anode is especially effective for greatly improving the luminous efficacy The anode is preferably made of one of metals having a high melting temperature, such as tungsten, tantalum and nickel. The work functions of these metals are 4.5V, 4.1V and 4.8V respectively. When a layer of at least one of materials selected from the group including Ba, BaO, $LaB_6$ and $Ba_2CaWO_6$ is provided on the surface of the anode made of such a metal, the work function of the anode decreases to a level of about 1.2V to 2.0V, with the result that the luminous efficacy of the low-pressure discharge lamp increases correspondingly.

Figure 4:
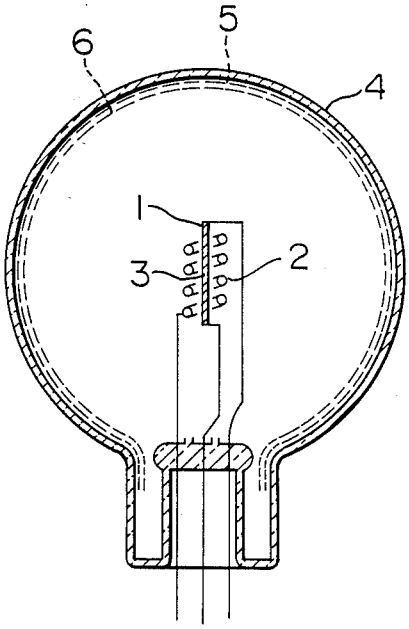
FIG. 4 is a schematic sectional view of a fourth embodiment of the low-pressure discharge lamp according to the present, invention.

Generally, a layer of at least one of electron emitting materials selected from the group including BaO, (Ba, Sr, Ca)0, $Ba_2CaWO_6$ and $LaB_6$ is coated on the surface of the cathode made of, for example, tungsten. When the distance between the cathode and the anode is selected to be small, the electron emitting materials spattered from the cathode attach to the anode, thereby decreasing the work function of the anode. Therefore, the luminous efficacy of the low-pressure discharge lamp increases without especially coating the surface of the anode with the electron emitting materials whose essential component is, for example, BaO. In a test in which the distance between the cathode and the anode of the low-pressure discharge lamp was selected to be smaller than 8 mm, the electron emitting materials scattered from the cathode attached markedly to the anode, and the luminous efficacy of the low-pressure discharge lamp could be greatly improved. Especially, in the low-pressure discharge lamp having an electrode arrangement in which the cathode is surrounded by the anode as shown in FIG. 4 and, in the low-pressure discharge lamp having an electrode arrangement in which the anode is surrounded by the cathode as shown in FIG. 5, the electron emitting materials spattered from the cathode attached efficiently to the anode, and the luminous efficacy could be markedly improved.

A lumen output test was conducted on the low-pressure discharge lamp of the present invention in which the anode was located in the zone of negative glow, and a rare gas and mercury vapor were mixed together to act as the discharge gases. In the test, various phosphors were coated on the inner wall of the discharge vessel, and the lumen outputs were plotted. The test results proved that, when a phosphor most widely used in conventional fluorescent lamps, such as $3Ca_3(PO_4)_2 \cdot Ca(F, Cl)_2$ : Sb, Mn or $3Sr_3(PO_4)_2 \cdot SrF_2$:Sb, Mn was coated on the inner wall of the discharge vessel, the lumen maintenance factor was degraded markedly after operation of the discharge lamp for a short period of time. Although the mechanism giving rise to such a marked degradation of the lumen maintenance factor has not been completely clarified, the reason why such a defect resulted is presumed as described below. That is, unlike conventional fluorescent lamps, the low-pressure discharge lamp of the present invention does not utilize the positive column but utilizes the plasma produced in the vicinity of the cathode. Therefore, electrons having high energy due to the cathode fall voltage of ten-odd volts are present in the plasma, and, because of the presence of such electrons, the energy of radiation and particles impinging against the inner wall of the discharge vessel is also high. It is presumed that the quality of the phosphor is degraded by the radiation and particles having the high energy.

On the other hand, the lumen maintenance factor was greatly improved when the inner wall of the discharge vessel was coated with at least one of rare earth activated phosphors such as $SrO \cdot SrF_2 \cdot 2B_2O_3$:Eu, $Sr_2P_2O_7$:Eu, $Sr_5(PO_4)_3Cl$:Eu, $(Sr, Ca)_5(PO_4)_3Cl$:Eu, $BaMg_2Al_{16}O_{27}$:Eu, $(Ba, Ca, Mg)_5(PO_4)_3CL$:Eu, $(Ce, Tb)MgAl_{11}O_{19}$, $LaPO_4$:Ce, Tb, $Y_2O_3$:Eu, and $Y(P, V)O_4$:Eu. That is, the inventors found out that the low-pressure discharge lamp of the present invention was practically usable only when such a rare earth activated phosphor was coated on the inner wall of the discharge vessel.

The discharge vessel of the low-pressure discharge lamp of the present invention is preferably made of one of lead glasses or one of soda-lime glasses from the viewpoints of, for example, the feasibility of shaping and the cost. However, when a layer of the rare earth activated phosphors was coated on the inner wall of the discharge vessel made of one of these glasses, the glass was blackened after continuous operation of the discharge lamp over a long period of time, and the lumen maintenance factor was degraded. It seems that the glass was blackened by high energy particles impinging against its inner wall. Therefore, when a dense coating layer of at least one of materials selected from the group including $Al_2O_3$, $SiO_2$, $P_2O_5$, $Sb_2O_5$ and MgO was interposed between the inner wall of the glass and the phosphor layer, the high energy particles could not reach the inner wall of the glass. Thus, the glass was not blackened, and the degradation of the lumen maintenance factor could be lessened.

In the low-pressure discharge lamp of the present invention in which the anode was located in the zone of negative glow, and a rare gas and mercury vapor were mixed together to act as the discharge gases, plasma produced as a result of discharge was substantially spherical in configuration In the low-pressure discharge lamp of the present invention, ultraviolet rays generated in such plasma were converted into visible rays by the phosphor layer provided on the inner wall of the discharge vessel Therefore, the luminous efficacy of the low-pressure discharge lamp became maximum when the discharge vessel was formed into a generally spherical shape so that the phosphors could be uniformly irradiated with the ultraviolet rays.

Figure 9:
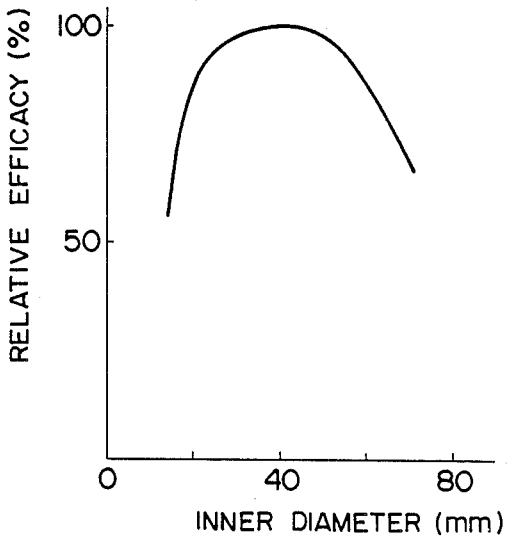
FIG. 9 is a graph showing the relation between the inner diameter of the discharge vessel and the relative efficacy of the low-pressure discharge lamp of the present invention.

In the low-pressure discharge lamp described above in which the anode was located in the zone of negative glow, and the spherical discharge vessel of glass was coated with the phosphor layer on its inner wall, argon was mixed with mercury vapor to provide the discharge gases, and the relation between the inner diameter of the spherical discharge vessel and the luminous efficacy was plotted. The phosphors were $Y_2O_3$: Eu and $LaPO_4$:Ce, Tb mixed at a ratio of 6:4. As shown in FIG. 9 representing the above relation, the luminous efficacy was high when the inner diameter of the spherical discharge vessel was in the range of from 20 mm to 60 mm. It is presumed that, when the inner diameter of the spherical discharge vessel is smaller than 20 mm, the luminous efficacy is degraded due to an increased proportion of absorption of light by the elements including the electrodes, while when the inner diameter of the spherical discharge vessel is larger than 60 mm, the distance between the plasma and the inner wall of the discharge vessel is excessively large, and the luminous efficacy is degraded due to an increased proportion of absorption of the ultraviolet rays by the mercury atoms. The inner diameter of the spherical discharge vessel of the lowpressure discharge lamp was selected to be 35 mm, and the relation between the temperature of the coldest spot of the low-pressure discharge lamp and the luminous efficacy was investigated by placing the discharge lamp in stationary air at an ambient temperature of 25° C. The luminous efficacy of the low-pressure discharge lamp of the present invention was maximum when the temperature of the coldest spot was 60° C, whereas the luminous efficacy of a conventional fluorescent lamp was maximum when the temperature of its coldest spot was about 40° C.

Generally, it is necessary to connect a ballast impedance in series with a discharge lamp in order to operate the discharge lamp. As this ballast impedance, a choke coil is most widely used. However, in the case of the low-pressure discharge lamp of the present invention in which the lamp voltage is lower than 20V, the use of the choke coil, which is relatively large in size and heavy in weight, is not practical. Also, when a capacitor is used as a ballast impedance in a conventional discharge lamp, flow of a pulsive and asymmetrical discharge current causes occurrence of flickers thereby shortening the useful service life of the discharge lamp and also increasing an internal loss of the capacitor. Thus, single use of the capacitor as the ballast impedance in a conventional discharge lamp was impossible as a matter of fact.

The inventors made various researches and studies about the possibility of use of a capacitor as a ballast impedance in the low-pressure discharge lamp of the present invention. As a result of the researches and studies, the inventors discovered that a symmetrical sine-wave discharge current flowed in spite of the use of the capacitor as the ballast impedance in the low-pressure discharge lamp of the present invention, and the absence of flickers of light ensured the normal service life of the discharge lamp and reduced the internal loss of the capacitor. It is considered that the ballast capacitor in the low-pressure discharge lamp of the present invention exhibits its satisfactory characteristic because the reignition voltage of the low-pressure discharge lamp is low due to the location of the anode in the zone of negative glow and also because the lamp voltage of the low-pressure discharge lamp is low. Thus, the ballast capacitor can exhibit its satisfactory characteristic only when it is combined with the low-pressure discharge lamp according to the present invention.

Figure 8:
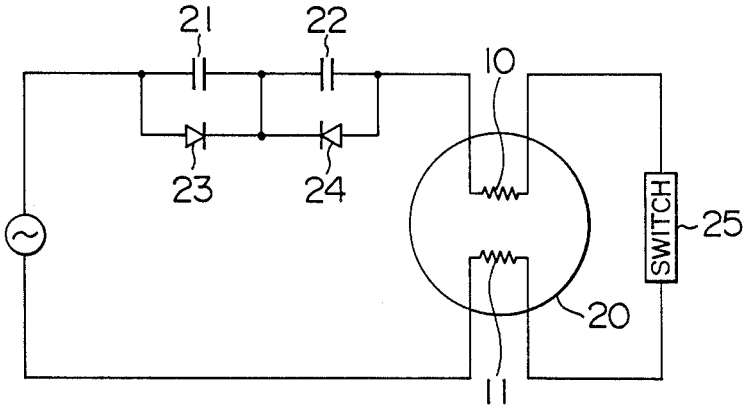
FIG. 8 is a circuit diagram of a lamp circuit of the low-pressure discharge lamp of the present invention.

An electrolytic capacitor having a large capacity in spite of a small size can only be used in a DC circuit. Therefore, in the low-pressure discharge lamp of the present invention, two electrolytic capacitors and two diodes were connected in an AC circuit as shown in FIG. 8. The characteristic exhibited by these electrolytic capacitors was equivalent to that of a metallized polyester film capacitor in spite of the fact that the electrolytic capacitors have a small volume which is only about one-half of that of the metallized polyester film capacitor. The electrolytic capacitors, which show an especially large internal loss against flow of a pulsive current, can properly exhibit their feature only when combined with the low-pressure discharge lamp of the present invention in which a symmetrical sine-wave discharge current flows as described above.

FIG. 8 shows that a small-sized bi-polarity switching element is connected in parallel with the low-pressure discharge lamp of the present invention. In the low-pressure discharge lamp of the present invention, the electrode acting as the anode is disposed in the zone of negative glow. Accordingly, the starting voltage is low, and the lamp voltage is also low. Because of the low starting voltage and low lamp voltage, a sufficient preheat current is supplied through the bi-polarity switching element thereby instantaneously initiating the discharge. Thus, the low-pressure discharge lamp of the present invention is advantageous in that provision of a single small-sized bi-polarity switching element can instantaneously initiate the discharge.

The above description has referred to a fluorescent lamp as an example of a low-pressure discharge lamp. However, it is apparent that the present invention is also applicable to an ultraviolet radiation lamp in which no phosphor layer is provided, and its discharge vessel is formed of a glass satisfactorily permeable to ultraviolet rays.

Preferred embodiments of the present invention will now be described in detail with reference to the accompanying drawings.

FIG. 1 is a schematic sectional view of a first embodiment of the low-pressure discharge lamp according to the present invention. Referring to FIG. 1, the low-pressure discharge lamp comprises a spherical discharge vessel 4 made of a soda-lime glass and having an inner diameter of 40 mm. A layer 5 of $Al_2O_3$ is coated on the inner wall of the spherical discharge vessel 4, and a layer 6 of rare earth activated phosphors, $Y_2O_3$:Eu and $LaPO_4$:Ce, Tb mixed at a ratio of 6:4, is coated on the $Al_2O_3$ layer 5. The $Al_2O_3$ layer 5 was provided by dispersing powder of $Al_2O_3$ having a particle size of about 20 $\mu$m in water and coating the dispersion.

A cathode 1 in the form of a tungsten coil of double coiled structure is disposed at about the center of the internal space of the spherical discharge vessel 4, and a layer 3 of electron emitting materials whose essential component is (Ba, Sr, Ca)O is coated on the cathode 1. An anode 2 is in the form of a nickel rod having a diameter of 1.2 mm and is partly covered with an electrical insulating sleeve 7. Krypton at 1.5 Torr is enclosed together with mercury particles in the discharge vessel 4 to act as discharge gases.

In the low-pressure discharge lamp shown in FIG. 1, the distance l between the cathode 1 and the anode 2 was set at 4 mm so as to place the anode 2 in the zone of negative glow. When this low-pressure discharge lamp was operated with a discharge current of 0.3 A, the low-pressure discharge lamp could discharge at a low lamp voltage of 10V without the need for continuously externally heating the cathode 1 and exhibited a high luminous efficacy of 29 lm $W^{-1}$. The lowest metastable potential of krypton is 9.8V which is included in the range of the lamp voltage of the discharge lamp according to the present invention, and the discharge was sufficiently stable. In the low-pressure discharge lamp shown in FIG. 1, the coldest spot was located at a sealing portion 8, and the temperature of the coldest spot was about 50° C.

In a low-pressure discharge lamp having a structure similar to that of the first embodiment shown in FIG. 1, the distance l between the cathode 1 and the anode 2 was set at 8 mm, and the surface of the anode 2 was coated with powder of $Ba_2CaWO_6$. The operating characteristics of this modified low-pressure discharge lamp were generally the same as those of the first embodiment. The first embodiment having such a relatively large distance between its cathode 1 and its anode 2 is advantagenous in that the electrodes can be simply arranged and assembled.

Figure 2:
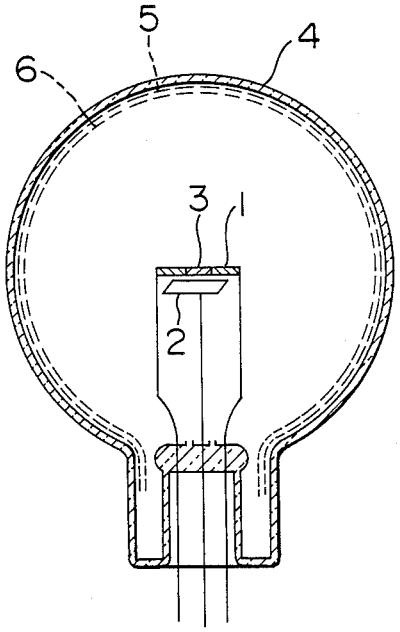
FIG. 2 is a schematic sectional view of a second embodiment of the low-pressure discharge lamp according to the present invention.

FIG. 2 is a schematic sectional view of a second embodiment of the low-pressure discharge lamp according to the present invention. This second embodiment is a partial modification of the first embodiment shown in FIG. 1, and the anode 2 is in the form of a strip extending along or in parallel to and separated about 4 mm from the cathode 1. The second embodiment is advantageous in that the anode 2 can efficiently arrest the electron emitting materials 3 spattered from the cathode 1.

FIG. 3 is a schematic sectional view of a third embodiment of the low-pressure discharge lamp according to the present invention. This third embodiment is also a partial modification of the first embodiment, and the anode 2 which is in the form of a hollow cylindrical member of nickel having an inner diameter of 9 mm and an axial length of 7 mm surrounds the cathode 1. Argon at 2.5 Torr and mercury particles were enclosed as the discharge gases in the discharge vessel 4 of this third embodiment.

In the low-pressure discharge lamp shown in FIG. 3, the shortest distance l between the cathode 1 and the anode 2 was set at 4 mm so as to place the anode 2 in the zone of negative glow. When the low-pressure discharge lamp was operated with a discharge current of 0.3 A, the low-pressure discharge lamp could discharge at a low lamp voltage of 13 V without the need for continuously externally heating the cathode 1 and exhibited a high luminous efficacy of 26 lm $W^{-1}$. This high luminous efficacy could be maintained over a long period of time. In the low-pressure discharge lamp shown in FIG. 3, the coldest spot was located at the sealing portion 8, and the temperature of this coldest spot was about 55° C.

When the hollow cylindrical anode 2 in the third embodiment shown in FIG. 3 is replaced by a cylindrical metal net or a cylindrical perforated metal sheet having many small perforations, light radiated from the plasma produced in the zone between the cathode 1 and the anode 2 can also be utilized to further enhance the luminous efficacy.

FIG. 4 is a schematic sectional view of a fourth embodiment of the low-pressure discharge lamp according to the present invention. This fourth embodiment is a partial modification of the third embodiment shown in FIG. 3, and the anode 2 is in the form of a coil which surrounds the cathode 1 and extends along the cathode 1. The distance between the anode 2 and the cathode 1 is about 2 mm. This fourth embodiment is advantageous in that the electrode arrangement and assembling can be facilitated.

FIG. 5 is a schematic sectional view of a fifth embodiment of the low-pressure discharge lamp according to the present invention. This fifth embodiment is a modification of the fourth embodiment shown in FIG. 4. Referring to FIG. 5, the anode 2 is in the form of a nickel rod having a diameter of 1.2 mm and is disposed at about the center of the spherical discharge vessel 4. The cathode 1 is in the form of a tungsten coil of triple coiled structure surrounding the anode 2 and is coated with the electron emitting materials 3 whose essential component is (Ba, Sr, Ca)0. Krypton at 1.5 Torr is enclosed together with mercury particles in the discharge vessel 4 to act as the discharge gases.

In the low-pressure discharge lamp shown in FIG. 5, the shortest distance l between the cathode 1 and the anode 2 was set at 2 mm so as to place the anode 2 in the zone of negative glow. When the low-pressure discharge lamp was operated with a discharge current of 0.3 A, the electron emitting materials 3 spattered from the cathode 1 attached efficiently to the anode 2, and the low-pressure discharge lamp could discharge at a low lamp voltage of 11V without the need for continuously externally heating the cathode 1 and exhibited a high luminous efficacy of 25 lm $W^{-1}$. This high luminous efficacy could be maintained over a long period of time. In the low-pressure discharge lamp shown in FIG. 5, the coldest spot was located at the sealing portion 8, and the temperature of this coldest spot was about 50° C.

Figure 6:
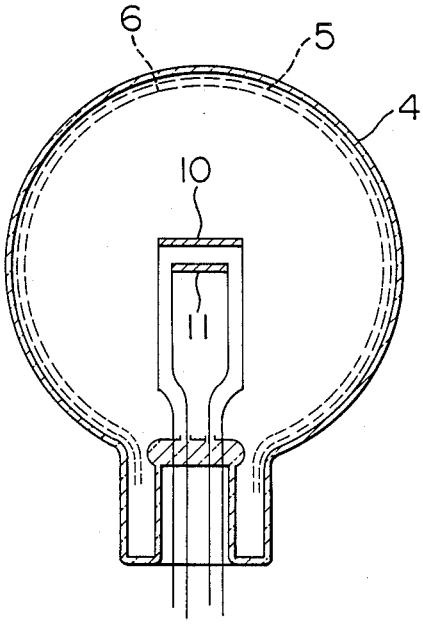
FIG. 6 is a schematic sectional view of a sixth embodiment of the low-pressure discharge lamp according to the present invention.

FIG. 6 is a schematic sectional view of a sixth embodiment of the low-pressure discharge lamp according to the present invention. Referring to FIG. 6, electrodes 11 and 12 coated with electron emitting materials are disposed at about the center of the internal space of a spherical discharge vessel 4. This sixth embodiment is generally the same as the first embodiment except that the electrodes 10 and 11 differ from the electrodes 1 and 2, the inner diameter of the spherical discharge vessel 4 is 50 mm, and argon at 2.5 Torr is enclosed as a rare gas. FIG. 8 shows a lamp circuit provided for operating this low-pressure discharge lamp. Referring to FIG. 8, electrolytic capacitors 21 and 22 are connected in series with the low-pressure discharge lamp designated by the reference numeral 20, and a bi-polarity switching element (Trade Name: SIDAC made by Shin-Dengen Kogyo K.K. in Japan) 25 having a breakover voltage of about 50V is connected in parallel with the low-pressure discharge lamp 20 as a discharge starter. In one half cycle of current supplied from an AC power supply, the current flows through a diode 23 and the capacitor 22, and, in the other half cycle, the current flows through a diode 24 and the capacitor 21. Thus, the electrolytic capacitors 21 and 22 are operated in a DC mode. Each of the electrolyric capacitors 21 and 22 has a capacitance of 33 μF. When the low-pressure discharge lamp 20 was operated by supplying a power supply voltage of 100V, discharge was instantaneously initiated. The input power was about 5W, and the luminous efficacy was as high as 23 lm $W^{-1}$. Further, the discharge current had a symmetrical sinusoidal waveform, and no flicker of light occurred. The total weight and total volume of the electrolytic capacitors 21, 22 and diodes 23, 24 were less than about 1/10 and about 1/5 respectively of the weight and volume of a choke coil. Also, the total weight and total volume described above were each about ½ of the weight and volume of a metallized polyester film capacitor. It will thus be seen that the use of a capacitor, especially, an electrolytic capacitor reduces the size and weight of the ballast impedance.

Figure 7:
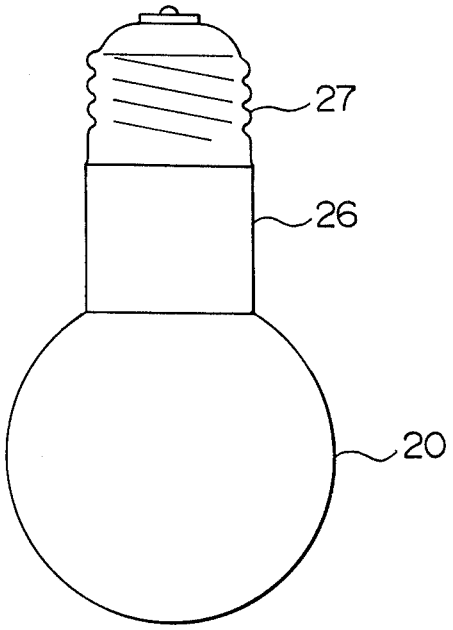
FIG. 7 is a perspective external view of a seventh embodiment of the low-pressure discharge lamp according to the present invention.

FIG. 7 is a schematic perspective external view of a seventh embodiment of the present invention. Referring to FIG. 7, a ballast accommodation casing 26 is mounted on the discharge vessel 4 of the low-pressure discharge lamp 20 shown in FIG. 6, and an Edison type end cap or base 27 is fixed to the casing 26. Since the capacitors 21, 22 and the diodes 23, 24 providing the ballast impedance, and the bi-polarity switching element 25 providing the discharge starter have a very small total volume, they can be accommodated in the ballast accommodation casing 26 of small size mounted on the spherical discharge vessel 4 having an inner diameter of 40 mm to 60 mm.

Further, the entire discharge lamp assembly including the ballast impedance is small in size and light in weight. Therefore, the low-pressure discharge lamp assembly shown in FIG. 7 is advantageous in that it can replace an incandescent filament lamp.

It will be understood from the foregoing detailed description that the present invention provides a low-pressure discharge lamp comprising an airtight discharge vessel, at least one pair of electrodes disposed in the discharge vessel and discharge gases enclosed in the discharge vessel, wherein the electrode arrangement is such that one of the electrodes which acts as an anode is located in a zone of negative glow, whereby the low-pressure discharge lamp can discharge at a low lamp voltage with a high luminous efficacy without the need for continuously externally heating the cathode. Further, when a capacitor and a bi-polarity switching element are combined as a ballast impedance and a starter respectively with the low-pressure discharge lamp, the discharge lamp of small size and light weight can immediately start to discharge in response to the actuation of the starter. Thus, when the ballast impedance and the starter are encased in a ballast accommodation casing mounted integrally on the discharge vessel of the discharge lamp of small size and light weight, the assembly can replace an incandescent filament lamp.

We claim:

1. A low-pressure discharge lamp comprising a discharge vessel defining an airtight space therein, at least one pair of electrodes disposed in said discharge vessel, one of said electrodes which acts as an anode being located at least partially in a zone of negative glow, and discharge gases enclosed in said discharge vessel including a rare gas as an essential component thereof, said rare gas being selected from the group consisting of argon and krypton, and a lamp voltage of said low-pressure discharge lamp when expressed in volts is between (Vm−2) and (Vm+4), where Vm is the lowest metastable potential of said rare gas.

2. A low-pressure discharge lamp according to claim 1, wherein one of said one pair of electrodes is a cathode, and the other is an anode.

3. A low-pressure discharge lamp according to claim 1, wherein said one pair o: electrodes act alternately as a cathode and an anode with respect to time.

4. A low-pressure discharge lamp according to claim 2, wherein said anode is shaped to surround said

5. A low-pressure discharge lamp according to claim 2, wherein said cathode is shaped to surround said anode.

6. A low-pressure discharge lamp according to claim 1, wherein a layer of rare earth activated phosphors is provided on the inner wall of said discharge vessel, and said discharge gases are a mixture of a rare gas and mercury vapor.

7. A low-pressure discharge lamp according to claim 2, wherein said anode is coated with a layer of at least one of materials selected from the group including Ba, BaO, $LaB_6$ and $Ba_2CaWO_6$.

8. A low-pressure discharge lamp according to claim 2, wherein the anode is made of a material selected from the group consisting of tungsten, tantalum and nickel.

9. A low-pressure discharge lamp according to claim 6 wherein said discharge vessel is generally spherical in shape.

10. A low-pressure discharge lamp according to claim 9, wherein said discharge vessel has an inner diameter ranging from 20 mm to 60 mm.

11. A low-pressure discharge lamp according to claim 6, wherein the material of said discharge vessel is a soda-lime glass or a lead glass, and a layer of at least one of materials selected from the group including $Al_2O_3$, $SiO_2$, $P_2O_5$, $Sb_2O_5$ and MgO is interposed between the inner wall of said glass vessel and said phosphor layer.

12. A low-pressure discharge lamp according to claim 1, wherein a capacitor is used as a ballast impedance for said low-pressure discharge lamp.

13. A low-pressure discharge lamp according to claim 12 wherein said capacitor is an electrolytic capacitor.

14. A low-pressure discharge lamp according to claim 1, wherein a bi-polarity switching element is used as a discharge starter for said low-pressure discharge lamp.

15. A low-pressure discharge lamp according o claim 4, wherein said anode is coated with a layer of at least one of materials selected from the group including Ba, BaO, $LaB_6$ and $Ba_2CaWO_6$.

16. A low-pressure discharge lamp according to claim 2, wherein the cathode is coated with an electron-emitting material selected from the group consisting of BaO, (Ba, Sr, Ca)0, $Ba_2CaWO_6$ and $LaB_6$, and wherein the distance between the anode and cathode are sufficiently small such that the electron-emitting material is caused to attach to the anode, thereby decreasing work function of the anode.

17. A low-pressure discharge lamp according to claim 6, wherein the rare earth activated phosphor is at least one selected from the group consisting of $SrO{\cdot}SrF_2{\cdot}2B_2O_3$:Eu, $Sr_2PO_7$:Eu, $Sr_5(PO_4)_3Cl$:Eu, $(Sr,Ca)_5(PO_4)_3Cl$:Eu, $BaMg_2Al_{16}O_{27}$:Eu, $(Ba,Ca,Mg)_5(PO_4)_3Cl$:Eu, $(Ce,Tb)MgAl_{11}O_{19}$, $LaPO_4$:Ce,Tb,$Y_2O_3$:Eu and $Y(P,V)O_4$:Eu.

18. A low-pressure discharge lamp according to claim 1, wherein the discharge gases also include mercury.

* * * * *